United States Patent [19]

Haugen

[11] Patent Number: 4,509,225

[45] Date of Patent: Apr. 9, 1985

[54] PRESSURE ROLL CLEANING SYSTEM

[75] Inventor: Orville C. Haugen, Bloomington, Minn.

[73] Assignee: Minnesota Mining and Manufacturing Company, St. Paul, Minn.

[21] Appl. No.: 459,342

[22] Filed: Jan. 20, 1983

[51] Int. Cl.[3] ..... B21B 45/02; G03G 21/00

[52] U.S. Cl. ..... 15/256.51; 355/3 FU; 355/15

[58] Field of Search ..... 355/15, 3 FU; 15/256.53; 118/652; 432/60

[56] References Cited

U.S. PATENT DOCUMENTS

| | | | |
|---|---|---|---|
| 3,340,577 | 9/1967 | Morrow et al. | 19/98 |
| 3,740,789 | 6/1973 | Ticknor | 355/15 X |
| 3,854,814 | 12/1974 | Jones | 355/15 |
| 3,868,744 | 3/1975 | Thettu | 355/15 X |
| 3,878,818 | 4/1975 | Thettu et al. | 355/15 X |
| 3,883,292 | 5/1975 | Hamaker | 432/60 |
| 3,942,889 | 3/1976 | Kurita et al. | 355/15 |
| 4,018,555 | 4/1977 | Thettu | 219/216 X |
| 4,111,545 | 9/1978 | Meltzer | 355/15 |
| 4,218,131 | 8/1980 | Ito et al. | 355/15 |
| 4,265,705 | 5/1981 | Pyykkonen | 162/272 |
| 4,277,161 | 7/1981 | Calabrese | 355/15 X |
| 4,285,090 | 8/1981 | Jurkowski | 355/15 X |
| 4,324,482 | 4/1982 | Szlucha | 15/256.52 X |

*Primary Examiner*—R. L. Moses

*Attorney, Agent, or Firm*—Donald M. Sell; James A. Smith; David W. Anderson

[57] ABSTRACT

A cleaning system for a pressure roll includes a doctor blade and a brush which is orbitally rotated by eccentric cams to propel accumulated material away from the junction of the blade and the roll and into a collection hopper.

5 Claims, 3 Drawing Figures

PRESSURE ROLL CLEANING SYSTEM

BACKGROUND OF THE INVENTION

1. Field of the Invention

This invention relates to the cleaning of foreign material from a moving surface and, more particularly, to the removal of excess toner from the fixing rolls of a copy machine.

2. Description of the Prior Art

A variety of situations exist in which the maintenance of a desired surface condition on a moving object is obtained by the utilization of a so-called "doctor blade," in which a leading free edge of the blade abuts against the moving surface to displace any undesired foreign matter. It is often found that notwithstanding the clearing effect of the doctor blade on the moving surface, the matter removed from the surface tends to accumulate at the point where the doctor blade meets the moving surface and the accumulated matter often drops to an undesired portion of the machinery involved.

This is particularly true of copy machines in which a light image of an original to be copied is typically recorded in the form of a latent electrostatic image upon a photosensitive member with subsequent rendering of the latent image visible by the application of electroscopic marking particles, commonly referred to as toner. The visual image can be either affixed directly upon the photosensitive member or transferred to a support member, which may be a sheet of plain paper, with subsequent affixing of the image thereto.

In order to permanently affix or fuse electroscopic toner material onto a support member, pressure must be applied to the toner particles which may or may not be accompanied by heating.

One approach to applying such pressure has been to pass the support member with the toner images between a pair of opposed fuser rolls, one of which may be internally heated. However, toner particles may be offset to the fuser roll by an insufficient application of heat to the surface, if the roll is to be heated; by imperfections in the surface of the roll; or by the toner particles insufficiently adhering to the support member by the electrostatic forces which normally hold them in place. In such a case, toner particles may be transferred to the surface of the fuser roll with subsequent transfer to a backup roll during periods when no copy paper is moving through the rolls. Moreover, toner particles may be picked up by the fuser and/or backup roll from the surroundings of the copying machine.

A doctor blade in contact with the fuser roll has proven effective in removing toner particles. However, there remains the problem of removing accumulated toner from the junction of the doctor blade and the fuser roll.

U.S. Pat. No. 4,218,131 issued to Ito et al. on Aug. 19, 1980, utilizes a screw-type auger to convey accumulated toner particles to a container where they may be reused. The drawback of this system is that a large amount of toner must accumulate at the junction of the doctor blade and the roll before such toner contacts the auger and is conveyed away.

It is desirable to provide a system which will continuously remove excess toner from the junction of the doctor blade and the fuser roll before the toner can accumulate and possibly drop to a portion of the machine where it might cause damage.

SUMMARY OF THE INVENTION

The cleaning system of the present invention continuously removes excess toner from the length of the junction between a doctor blade and a fuser roll by providing a brush extending the length of the blade which is orbited by cams to contact the roll and the blade at the junction of the two and move in a plane parallel to the plane of the blade in a direction perpendicular to the junction to force excess toner across the blade and into a hopper where it may be removed.

BRIEF DESCRIPTION OF THE DRAWING

The present invention will be more thoroughly described with reference to the accompanying drawing wherein like numbers refer to like parts in the several views, and wherein.

DESCRIPTION OF THE PREFERRED EMBODIMENT

Figure 1:
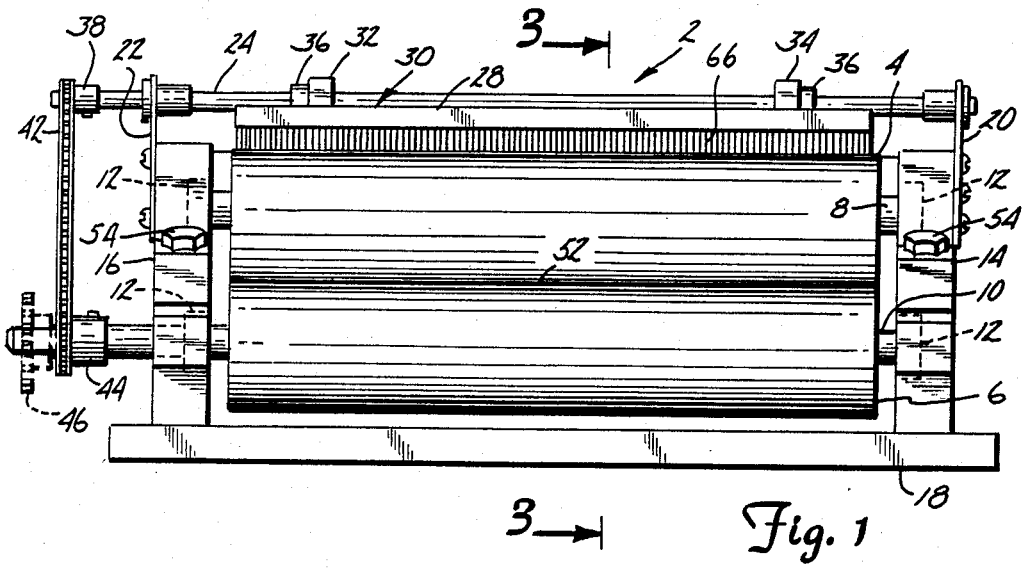
FIG. 1 is a front elevational view of a pair of fuser rolls and the cleaning system of the present invention.

With reference to FIG. 1, there is shown a pressure application system 2 which includes a pressure roll 4 and a backup roll 6 which are supported by shafts 8 and 10 journalled in bearings 12 seated in upright side frames 14 and 16. The side frames 14 and 16 are commonly supported by a base 18.

Figure 2:
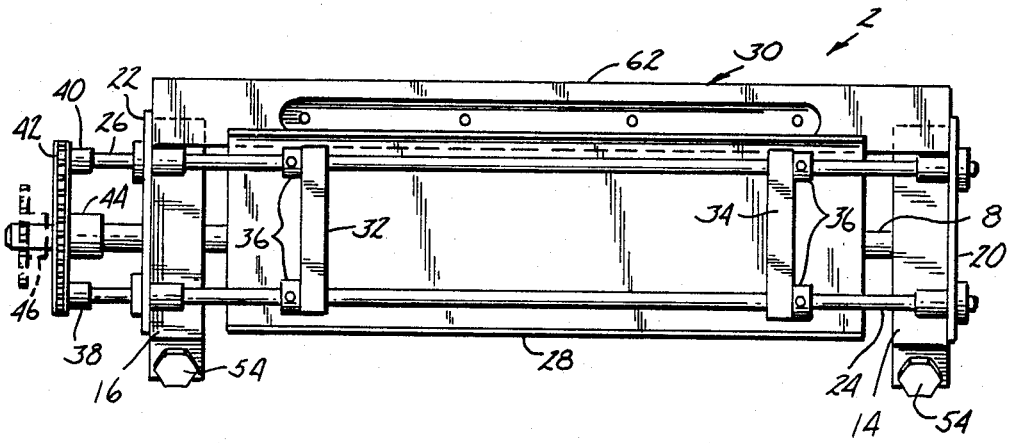
FIG. 2 is a top plan view of the cleaning system of FIG. 1.

As best seen in FIG. 2, there is supported above the pressure roll 4 by means of side plates 20 and 22 two brush shafts 24 and 26 which in turn support a brush 28 which constitutes a portion of a pressure roll cleaning system, generally indicated as 30. The brush 28 is suspended from support blocks 32 and 34 which are axially located along the brush shafts 24 and 26 by collars 36.

At one end of the brush shafts 24 and 26 are located sprockets 38 and 40, respectively, which are synchronously driven by a chain 42 which is in turn driven by a sprocket 44 attached to the backup roll shaft 10. The backup roll shaft 10 is rotated by a motor (not shown) which may be connected to the shaft 10 by means of a main drive sprocket 46, shown in phantom lines. Rotation of the backup roll shaft 10, therefore, produces rotation of the backup roll 6, rotation of the brush shafts 24 and 26, and, through contact between the pressure roll 4 and the backup roll 6, rotation of the pressure roll 4.

Figure 3:
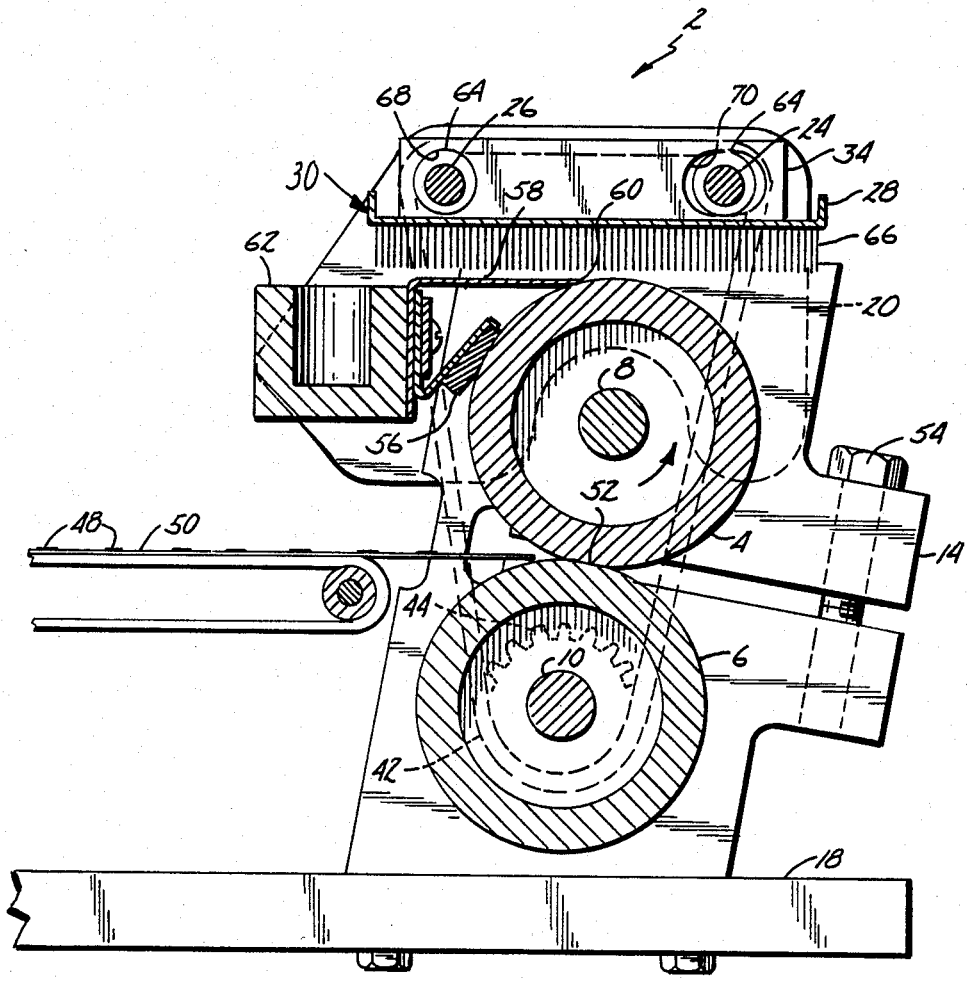
FIG. 3 is a cross-sectional view of the rolls and cleaning system of FIG. 1 taken generally along the line 3—3 of FIG. 1 with a drive means shown in phantom lines.

The operation of the pressure application system 2 and the pressure roll cleaning system 30 will be described with reference to FIG. 3. The pressure application system 2 has general utility in such fields as the textile or paper industries, but will be described as it applies to the fixing portion of a copy machine. This particular application should not, however, limit the applicability of the invention.

In order to permanently affix or fuse electroscopic toner particles 48 onto a support member 50, usually plain copy paper, pressure must be applied to the toner particles 48 prior to the copy paper 50 exiting the copy machine. This pressure may be applied by feeding the paper 50 through a nip 52 formed at the line of contact of the pressure roll 4 and backup roll 6 described above. As shown in FIGS. 2 and 3, the pressure between the two rolls 4 and 6 may be adjusted by flexing the side frames 14 and 16 by means of adjustment screws 54. The pressure between the rolls 4 and 6 is typically adjusted to a value of approximately 400 pounds per linear inch.

During the feeding of the copy paper 50 through the nip 52 of the rollers 4 and 6, minute particles of toner 48 may adhere to the pressure roll 4 and may be carried to the backup roll 6 after the passage of the copy paper 50. This adherence of toner particles 48 to the pressure roll 4 is commonly referred to as "offsetting" and may be caused by insufficient heating of the pressure roll 4, if heat is to be applied; by imperfections in the surface of the pressure roll 4; or by the toner particles 48 insufficiently adhering to the copy paper 50 by the electrostatic forces which normally hold them in place. To combat such offsetting, there is typically provided in a copy machine a felt wick 56 in contact with the pressure roll 4 and saturated with silicon oil. A thin layer of silicon oil applied to the surface of the pressure roll 4 forms an interface between the surface of roll 4 and the toner particles 48 carried on the copy paper 50. A low surface energy layer is thereby presented to the toner particles 48 as they pass through the nip 52 which thereby reduces the amount of toner 48 offset to the pressure roll 4. Further insurance against toner 48 offset is provided by a doctor blade 58 which contacts the pressure roll 4 and scrapes toner particles 48 from the surface of the pressure roll 4. The drawback of using such a doctor blade 58 is that toner 48 accumulates at the junction 60 of the blade 58 and the pressure roll 4 and may drop onto subsequent sheets of copy paper 50 or into the internal mechanism of the copy machine.

It is, therefore, necessary to remove accumulated toner 48 from the junction 60 of the blade and the pressure roll 4. This is accomplished according to the present invention by providing the brush 28 which forces toner 48 from the junction 60 to a hopper 62 from which accumulated toner 48 may be removed by conventional means such as vacuum, a conveyor, or a helical screw auger system.

The brush 28 performs its function by orbitally revolving around the brush shafts 24 and 26. This orbital motion is produced by single-lobed cams 64 which rotate with the shafts 24 and 26 and are journalled within the support blocks 32 and 34 from which the brush 28 is suspended. The cams 64 cause the bristles 66 of the brush 28 to contact the surface of the pressure roll 4 and the doctor blade 58 as the brush 28 is moved toward the hopper 62. After reaching the limit of its travel toward the hooper 62, the brush 28 is raised by the cams 64 and moved to a position away from the hopper 62. Thus, the bristles 66 of the brush 28 are only in contact with the doctor blade 58 and the pressure roll 4 during the stroke of the brush 28 toward the hopper 62. In addition, the bristles 66 are somewhat compressed by contact with the pressure roll 4 and the doctor blade 58 and "flick" toward the hopper 62 when the brush 28 is raised at the end of its stroke. This flicking action operates to propel toner 48 from the brush 28 into the hopper 62 and prevent clogging of the brush 28. The bristles 66 of the brush 28 are preferably polyester, which has a low affinity for toner 48, with a length of approximately 0.25 inches (6.4 mm). This length has been found to provide the proper "flicking" motion described above.

Since the brush shafts 24 and 26 are driven by the backup roll 6 through the chain 42, the brush 28 will operate continuously during the fusing process to remove accumulated toner 48 from the junction 60 of the blade 58 and the pressure roll 4, thereby preventing the accumulation of the toner 48 at the junction 60.

Two of the four cams 64 associated with one of the brush shafts 24 or 26 are journalled within circular holes 68 while the remaining cams 64 are journalled within elongated slots 70 having a vertically oriented minor axis equal to the diameter of the circular holes 68 and a major axis greater than the eccentricity of the cams 64. The cams within the slots 70 thereby impart no motion to the brush 28 in a horizontal plane but only operate to raise and lower the brush 28 in a vertical plane. The slot is provided so that the two sets of cams 64 do not work in opposition to each other in the event one or more of the cams 64 are slightly misoriented. Either of the sets of cams 64 could be provided with the slots 70.

While the present invention has been described in connection with a certain specific embodiment, it is to be understood that it is not to be limited to this embodiment. On the contrary, it is intended to cover all alternatives and modifications falling within the spirit and scope of the invention as set forth in the appended claims.

I claim:

1. A cleaning apparatus in combination with a moving surface and a doctor blade having a free end engaging said surface along a line to scrape and thereby clean said surface of foreign material, said cleaning apparatus comprising:

a brush having a longitudinal axis extending parallel to said line of engagement between said blade and said surface; and means for orbitally moving said brush into and out of contact with said surface and in a direction perpendicular to said line of engagement to force said foreign material away from said line of engagement and across said blade.

2. A cleaning apparatus according to claim 1 wherein said moving surface is a roll having a longitudinal axis parallel to said line of engagement and said brush longitudinal axis extends parallel to said roll axis and said brush contacts said roll substantially along the length of said roll.

3. A cleaning apparatus according to claim 1 wherein said means for orbitally moving said brush comprises an eccentric cam coupled to said brush.

4. A cleaning apparatus according to claim 3 wherein said brush includes resilient bristles which are deformed by said contact of said brush with said roll and return to an undeformed state when said contact ceases so that said foreign material is propelled away from said bristles when said contact ceases.

5. A cleaning apparatus according to claim 3 wherein said moving surface is a roll having a longitudinal axis parallel to said line of engagement and said brush longitudinal axis extends parallel to said roll axis and said brush contacts said roll substantially along the length of said roll.

* * * * *